US006125248A

United States Patent [19]

Moser

[11] Patent Number: 6,125,248

[45] Date of Patent: Sep. 26, 2000

[54] ELECTROSTATOGRAPHIC REPRODUCTION MACHINE INCLUDING A PLURALITY OF SELECTABLE FUSING ASSEMBLIES

[75] Inventor: Rabin Moser, Victor, N.Y.

[73] Assignee: Xerox Corporation, Stamford, Conn.

[21] Appl. No.: 09/360,795

[22] Filed: Jul. 26, 1999

Related U.S. Application Data

[60] Provisional application No. 60/110,208, Nov. 30, 1998.

[51] Int. Cl.[7] ..... G03G 15/20

[52] U.S. Cl. ..... 399/68; 399/320

[58] Field of Search ..... 399/67, 68, 328, 399/321, 322, 330, 233, 122, 320; 219/216

[56] References Cited

U.S. PATENT DOCUMENTS 5,296,904 3/1994 Jackson ..... 399/328
5,515,155 5/1996 Folkins ..... 399/223

FOREIGN PATENT DOCUMENTS 2-127681 5/1990 Japan .

*Primary Examiner*—Quana M. Grainger
*Attorney, Agent, or Firm*—Tallam I. Nguti

[57] ABSTRACT

An electrostatographic reproduction machine is provided for reliably producing high quality toner particle images of original images on sheet substrates. The reproduction machine includes (i) a movable image bearing member mounted drivably to a frame and having an image bearing surface defining a path of movement thereof; (ii) electrostatographic imaging elements mounted at various distributed locations along the path of movement for forming toner particle images of original images on the image bearing surface; (iii) a transfer assembly for transferring the toner particle images onto sheet substrates; (iv) a controller for controlling the forming and transfer of toner particle images at a machine front end speed of N copies per minute; and (v) a plurality of M fusing assemblies for applying heat and pressure to toner particle images on sheet substrates so as to fuse and permanently fix such toner images onto the sheet substrates, each fusing assembly of the plurality of M fusing assemblies having at least two different copies per minute fusing speeds including a minimum speed of N/M copies per minute, thereby allowing for increasing image quality, and insuring machine reliability and productivity.

5 Claims, 2 Drawing Sheets

ELECTROSTATOGRAPHIC REPRODUCTION MACHINE INCLUDING A PLURALITY OF SELECTABLE FUSING ASSEMBLIES

This application is based on a provisional application No. 60/110,208, filed on Nov. 30, 1998.

BACKGROUND OF THE INVENTION

This invention relates to electrostatographic reproduction machines, and more particularly to such a machine including a plurality of selectable fusing assemblies for increasing image quality and insuring machine reliability and productivity.

Generally, the process of electrostatographic reproduction, as practiced in electrostatographic reproduction machines, includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station, records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner material adhering triobelectrically thereto. A single component dry developer material typically comprising toner material only can also be used. The toner image formed by such development is subsequently transferred at a transfer station onto a copy sheet fed to such transfer station, and on which the toner material image is then heated and permanently fused, as by heat and pressure, so as to form a "hardcopy" of the original image.

In order to permanently fix or fuse toner material onto a copy sheet or support member by heat and pressure rolls, it is ordinarily necessary to apply pressure and elevate the temperature of the toner to a point at which the toner material becomes tacky and coalesces. This action causes the toner to flow to some extent into the fibers or pores of the support medium (typically paper). Thereafter, as the toner material cools, solidification of the toner material occurs, causing the toner material to be bonded firmly to the support member. In both the xerographic as well as the electrographic recording arts, the use of thermal energy and pressure for fusing toner images, black and white or multicolor, onto a support member is old and well known.

It has been found that fusing assemblies, that include a fuser roll and a pressure roll and are used in multicolor machines to fuse multicolor toner images, intrinsically have shorter fuser roll lives as compared to black and white fusing assemblies operating at comparable copy rates. In addition, color image fusing assemblies typically produce borderline gloss and fusing level acceptability in image quality. In particular, it has been found that the faster the speed of the fusing assembly, the less acceptable the performance and quality. For example, attempting to increase the speed of a fusing assembly or fuser from 65 cpm (copies per minute) for which it is originally designed, to 72 cpm rendered its performance less than acceptable. However, it was found that if the same fuser (originally designed for 65 cpm) was run instead at a lower speed of say 36 ppm, the performance was significantly improved and the range of gloss output increased, apparently because thermal stresses on it were reduced.

SUMMARY OF THE INVENTION

In accordance with the present invention, there is provided an electrostatographic reproduction machine is provided for reliably producing high quality toner particle images of original images on sheet substrates. The reproduction machine includes (i) a movable image bearing member mounted drivably to a frame and having an image bearing surface defining a path of movement thereof; (ii) electrostatographic imaging elements mounted at various distributed locations along the path of movement for forming toner particle images of original images on the image bearing surface; (iii) a transfer assembly for transferring the toner particle images onto sheet substrates; (iv) a controller for controlling the forming and transfer of toner particle images at a machine front end speed of N copies per minute; and (v) a plurality of M fusing assemblies for applying heat and pressure to toner particle images on sheet substrates so as to fuse and permanently fix such toner images onto the sheet substrates, each fusing assembly of the plurality of M fusing assemblies having at lease two different copies per minute fusing speeds including a minimum speed of N/M copies per minute, thereby allowing for increasing image quality, and insuring machine reliability and productivity.

BRIEF DESCRIPTION OF THE DRAWINGS

These and other aspects of the present invention will become apparent from the following description in conjunction with the accompanying drawings in which.

DETAILED DESCRIPTION OF THE INVENTION

Figure 1:
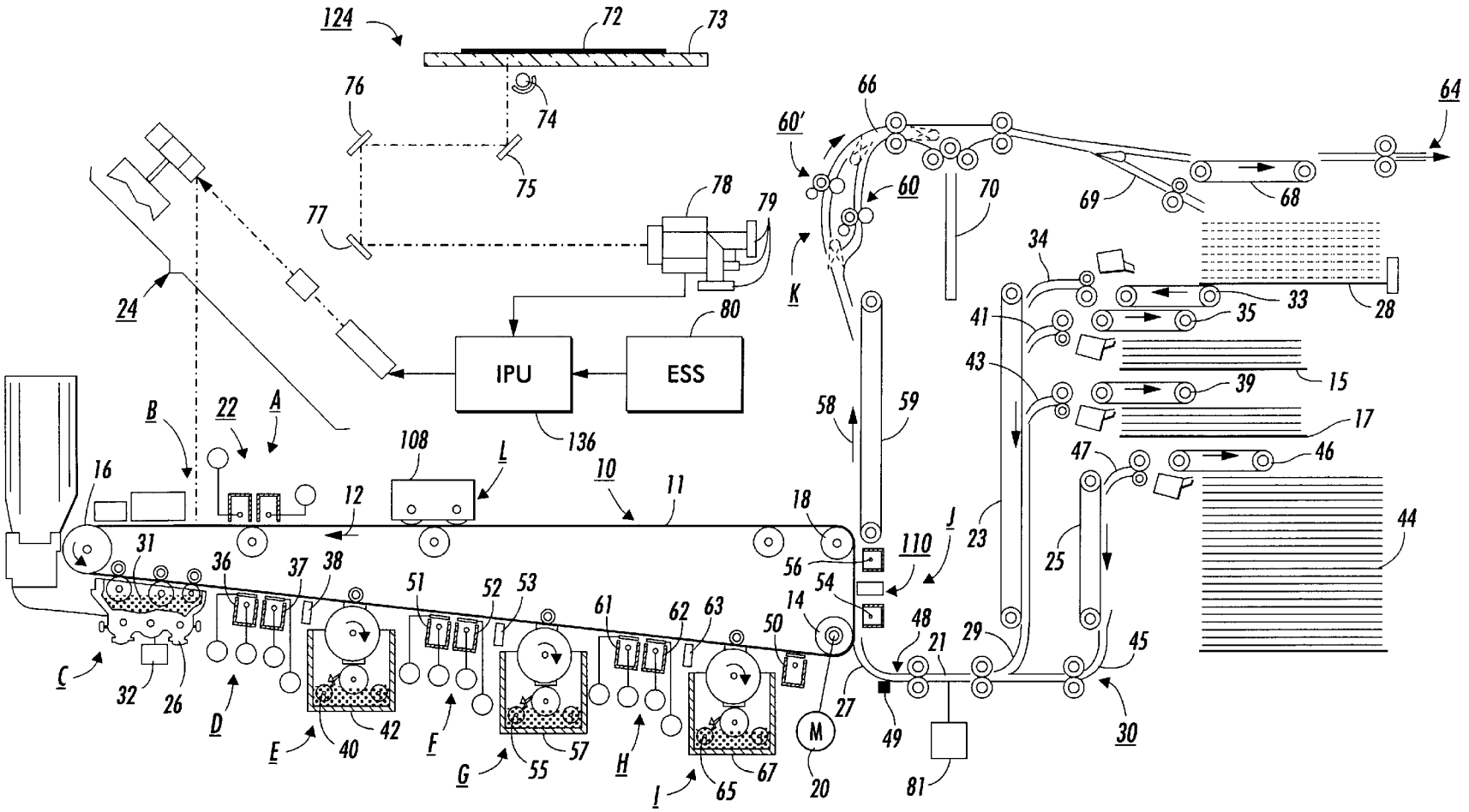
FIG. 1 is a schematic illustration of an exemplary image-on-image color printing machine incorporating the plurality of fusing assemblies in accordance with the present invention.

For a general understanding of the features of the present invention, reference is made to the drawings, wherein like reference numerals have been used throughout to identify the same or similar elements. Although the following description will be directed to an image-on-image color printing machine, it will be understood that the present invention contemplates the use of various alternative embodiments, including black and white printing machines. On the contrary, the following description is intended to cover all alternatives, modifications, and equivalents, as may be included within the spirit and scope of the invention as defined by the appended claims.

Referring to FIG. 1, there is depicted an exemplary image-on-image printing machine 8. As is well known, the color copy process typically involves a computer generated color image which may be conveyed to an image processor 136, or alternatively a color document 72 which may be placed on the surface of a transparent platen 73. A scanning assembly 124, having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital image signal the level of which is proportional to the intensity of the incident light. The digital signals represent each pixel and are indicative of blue, green, and red densities. They are conveyed to the IPU 136 where they are converted into color separations and bit maps, typically representing yellow, cyan, magenta, and black. IPU 136 stores the bit maps for further instructions from an electronic subsystem (ESS) 80.

The ESS is preferably a self-contained, dedicated minicomputer having a central processor unit (CPU), electronic storage, and a display or user interface (UI). The ESS is the control system which prepares and manages the image data flow between IPU 136 and image input terminal 122, 124, as well as being the main multi-tasking processor for operating all of the other machine subsystems and printing operations. The printing operations include imaging, development, sheet delivery and transfer, and the plurality of fusing assemblies in accordance with the present invention (to be described in detail hereinafter), as well as various functions associated with subsequent finishing processes. Some or all of these subsystems may have micro-controllers that communicate with the ESS 80.

The printing machine 8 employs a photoreceptor 10 in the form of a belt having a photoconductive surface layer 11 on an electroconductive substrate 13. Preferably the surface 11 is made from an organic photoconductive material, although numerous photoconductive surfaces and conductive substrates may be employed. The belt 10 is driven by means of motor 20 having an encoder attached thereto (not shown) to generate a machine timing clock. Photoreceptor 10 moves along a path defined by rollers 14, 18, and 16 in a counterclockwise direction as shown by arrow 12.

Initially, the photoreceptor 10 passes through charging station A where a corona generating device, indicated generally by the reference numeral 22, charges photoreceptor 10 to a relatively high, substantially uniform potential. Next, the charged portion of photoreceptor 10 is advanced through an imaging station B. At imaging station B, the uniformly charged belt 10 is exposed to the scanning device 24 which causes the photoreceptor to be discharged in accordance with the output from the scanning device. The scanning device is a laser Raster Output Scanner (ROS). The ROS creates the image in a series of parallel scan lines having a certain resolution, generally referred to as lines per inch. Scanning device 24 may include a laser with rotating polygon mirror blocks and a suitable modulator, or in lieu thereof, a light emitting diode array (LED) write bar positioned adjacent the photoreceptor 10.

At a first development station C, a magnetic brush developer unit, indicated generally by the reference numeral 26 advances developer material 31 into contact with the latent image and latent target marks. Developer unit 26 has a plurality of magnetic brush roller members. These magnetic brush rollers transport negatively charged black toner material to the latent image for development thereof. Power supply 32 electrically biases developer unit 26.

At recharging station D, a pair of corona recharge devices 36 and 37 are employed for adjusting the voltage level of both the toned and untoned areas on photoreceptor 10 to a substantially uniform level. A power supply is coupled to each of the electrodes of corona recharge devices 36 and 37. Recharging devices 36 and 37 substantially eliminate any voltage difference between toned areas and bare untoned areas, as well as to reduce the level of residual charge remaining on the previously toned areas, so that subsequent development of different color toner images is effected across a uniform development field.

Imaging devices 38, 53, and 63 are used to superimpose subsequent images by selectively discharging the recharged photoreceptor. These imaging devices may include, for example, a LED image array bar, or another ROS. On skilled in the art will appreciate that the operation of imaging devices 38, 53, and 63 are also controlled by ESS 80. Moreover, one skilled in the art will recognize that those areas developed with black toner will not be subjected to sufficient light from the imaging devices to discharge the photoreceptor region lying below the black toner particles. However, this is of no concern as there is little likelihood of a need to deposit other colors over the black regions.

Imaging device 38 records a second electrostatic latent image on photoreceptor 10. A negatively charged developer material 40, for example, one including yellow toner, develops the second latent image. The toner is contained in a developer unit 42 disposed at a second developer station E and is transported to the second latent image recorded on the photoreceptor by a donor roll. A power supply (not shown) electrically biases the developer unit to develop this latent image with the negatively charged yellow toner particles 40. As will be further appreciated by those skilled in the art, the yellow colorant is deposited immediately subsequent to the black so that further colors that are additive to yellow, and interact therewith to produce the available color gamut, can be exposed through the yellow toner layer.

At a second recharging station F, a pair of corona recharge devices 51 and 52 are employed for adjusting the voltage level of both the toned and untoned areas on photoreceptor 10 to a substantially uniform level. A power supply is coupled to each of the electrodes of corona recharge devices 51 and 52. The recharging devices 51 and 52 substantially eliminate any voltage difference between toned areas and bare untoned areas, as well as to reduce the level of residual charge remaining on the previously toned areas so that subsequent development of different color toner images is effected across a uniform development field. A third latent image is then recorded on photoreceptor 10 by imaging device 53. This image is developed using a third color toner 55 contained in a developer unit 57 disposed at a third developer station G. An example of a suitable third color toner is magenta. Suitable electrical biasing of the developer unit 57 is provided by a power supply, not shown.

At a third recharging station H, a pair of corona recharge devices 61 and 62 adjust the voltage level of both the toned and untoned areas on photoreceptor 10 to a substantially uniform level. A power supply is coupled to each of the electrodes of corona recharge devices 61 and 62. The recharging devices 61 and 62 substantially eliminate any voltage difference between toned areas and bare untoned areas as well as to reduce the level of residual charge remaining on the previously toned areas, so that subsequent development of different color toner images is effected across a uniform development field A fourth latent image is created using imaging device 63. The fourth latent image is formed on both bare areas and previously toned areas of photoreceptor 10 that are to be developed with the fourth color image. This image is developed, for example, using a cyan color toner 65 contained in developer unit 67 at a fourth developer station I. Suitable electrical biasing of the developer unit 67 is provided by a power supply, not shown.

Developer units 42, 57, and 67 are preferably of the type known in the art which do not interact, or are only marginally interactive with previously developed images. For examples, a DC jumping development system, a powder cloud development system, or a sparse, non-contacting magnetic brush development system are each suitable for use in an image on image color development system as described herein.

In order to condition the toner for effective transfer to a substrate, a negative pre-transfer corotron member 50 negatively charges all toner particles to the required negative polarity to ensure proper subsequent transfer.

During the exposure and development of the color image on the photoconductor, a sheet of support material is advanced to transfer station J by a sheet feeding apparatus 30. During simplex operation (single sided copy), a blank sheet may be fed from tray 15 or tray 17, or a high capacity tray 44 thereunder, to a registration transport 21, in communication with controller 81, where the sheet is registered in the process and lateral directions, and for skew position. One skilled in the art will realize that trays 15, 17, and 44 each hold a different sheet type. The speed of the sheet is adjusted at registration transport 21 so that the sheet arrives at transfer station J in synchronization with the image on the surface of photoconductive belt 10. Registration transport 21 receives a sheet from either a vertical transport 23 or a high capacity tray transport 25 and moves the received sheet to a pretransfer baffle 27. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet from trays 15 and 17 to the vertical transport 23 by chutes 41 and 43. The high capacity tray transport 25 receives the sheet from tray 44 and guides it to the registration transport 21 via a lower baffle 45. A sheet feeder 46 advances copy sheets from tray 44 to transport 25 by a chute 47.

The pretransfer baffle 27 guides the sheet from the registration transport 21 to transfer station J. Charge limiter 49 located on pretransfer baffle 27 restricts the amount of electrostatic charge a sheet can place on the baffle 27 thereby reducing image quality problems and shock hazards. The charge can be placed on the baffle from either the movement of the sheet through the baffle or by the corona generating devices located at transfer station J. When the charge exceeds a threshold limit, charge limiter 49 discharges the excess to ground.

Transfer station J includes a transfer corona device 54 which provides positive ions to the backside of the copy sheet. This attracts the negatively charged toner powder images from photoreceptor belt 10 to the sheet. A detack corona device 56 is provided for facilitating stripping of the sheet from belt 10.

A sheet-to-image registration detector 110 is located in the gap between the transfer and corona devices 54 and 56 to sense variations in actual sheet to image registration and provides signals indicative thereof to ESS 80 and controller 81 while the sheet is still tacked to photoreceptor belt 10. The ESS 80 or controller is connected to the image bearing member or photoreceptor, and to the other electrostatographic imaging elements and transfer means, for controlling their movements, and the forming and transfer of toner particle images thereby at a machine front end speed for example, of N copies per minute.

After such image transfer, and after the sheet of support material is separated from photoreceptor 10, residual toner remaining on the photoreceptor surface is removed therefrom at cleaning station L using, for example, a cleaning brush structure contained in a unit 108. Meanwhile, the sheet carrying the transferred toner image continues to move, in the direction of arrow 58, onto a conveyor 59 that advances the sheet to fusing station K which includes the plurality of fusing assemblies in separate fusing assemblies, as shown in the drawings, accordance with the present invention.

Figure 2:
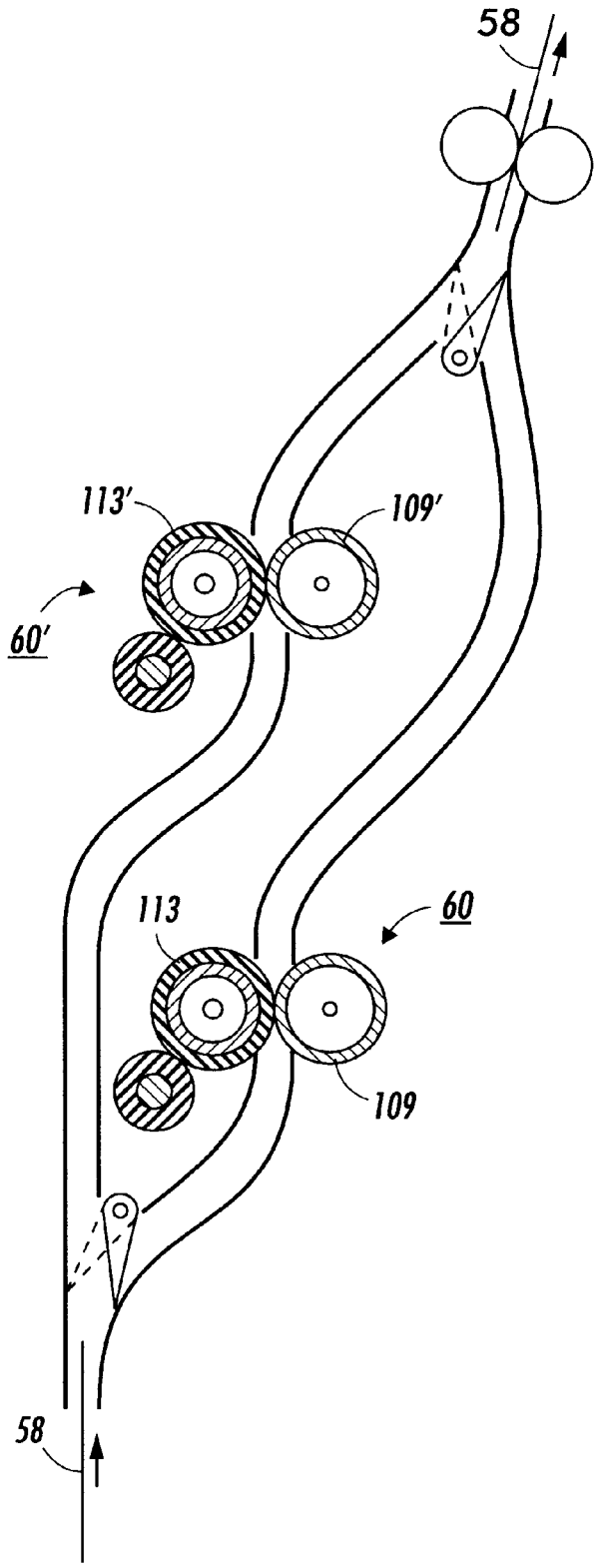
FIG. 2 is a detailed illustration of the plurality of fusing assemblies of FIG. 1 in accordance with the present invention.

Referring now to FIGS. 1 and 2, fusing station K comprises a plurality of fusing assemblies including a first fusing assembly 60, and a second 60' which are each capable permanently fixing the transferred color image to the copy sheet. Although only two assemblies are shown, it is understood that more than two and up, to a number M can be arranged. Preferably, fuser assembly 60, 60' comprises a heated fuser roller 109, 109' and a backup or pressure roller 113, 113'. The copy sheet passes between fuser roller 109, 109' and backup roller 113, 113' with the toner powder image contacting fuser roller 109, 109'. In this manner, the multicolor toner powder image is permanently fixed to the sheet. After fusing, chute 66 guides the advancing sheet to feeder 68 for exit to a finishing module (not shown) via output 64. However, for duplex operation, the sheet is reversed in position at inverter 70 and transported to duplex tray 28 via chute 69. Duplex tray 28 temporarily collects the sheet whereby sheet feeder 33 then advances it to the vertical transport 23 via chute 34. The sheet fed from duplex tray 28 receives an image on the second side thereof, at transfer station J, in the same manner as the image was deposited on the first side thereof. The completed duplex copy exits to the finishing module (not shown) via output 64.

The plurality of M fusing assemblies apply heat and pressure to toner particle images on sheet substrates so as to fuse and permanently fix such toner images onto the substrates. Each fusing assembly of the plurality of M fusing assemblies has at lease two different copies per minute fusing speeds, including a minimum speed of N/M copies per minute, thereby allowing for increasing image quality, and insuring machine reliability and productivity. Preferably, the electrostatographic reproduction machine of, wherein said at lease two different copies per minute fusing speeds of each fusing assembly of said plurality of M fusing assemblies includes a maximum speed of N copies per minute. The at lease two different copies per minute fusing speeds of each fusing assembly are selectable. The plurality of M fusing assemblies are mounted along parallel axis, and each includes means for receiving sheet substrates from said transfer means. Color fusers or fusing assemblies intrinsically have shorter fuser roll lives than do black and white fusers operating at comparable copy rates. In accordance with the present invention, two identical fusers 60, 60' are installed into a high productivity color printer to double the copy rate capability and the fuser roll replacement interval.

It is, therefore, evident that there has been provided, in accordance with the present invention an electrostatographic reproduction machine is provided for reliably producing high quality toner particle images of original images on sheet substrates. The reproduction machine includes (i) a movable image bearing member mounted drivably to a frame and having an image bearing surface defining a path of movement thereof; (ii) electrostatographic imaging elements mounted at various distributed locations along the path of movement for forming toner particle images of original images on the image bearing surface; (iii) a transfer assembly for transferring the toner particle images onto sheet substrates; (iv) a controller for controlling the forming and transfer of toner particle images at a machine front end speed of N copies per minute; and (v) a plurality of M fusing assemblies for applying heat and pressure to toner particle images on sheet substrates so as to fuse and permanently fix such toner images onto the sheet substrates, each fusing assembly of the plurality of M fusing assemblies having at least two different copies per minute fusing speeds including a minimum speed of N/M copies per minute, thereby allowing for increasing image quality, and insuring machine reliability and productivity.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. An electrostatographic reproduction machine for reliably producing high quality toner particle images of original images on sheet substrates, the reproduction machine comprising:

(a) a movable image bearing member mounted drivably to a frame, said image bearing member having an image bearing surface defining a path of movement thereof;

(b) electrostatographic imaging elements mounted at various distributed locations along said path of movement for forming toner particle images of original images on said image bearing surface;

(c) transfer means for transferring the toner particle images onto sheet substrates for fusing;

(d) a controller connected to said image bearing member mounted drivably, to said electrostatographic imaging elements and said transfer means, for controlling their movements and the forming and transfer of toner particle images thereby at a machine front end speed of N copies per minute; and (e) a plurality of M separate fusing assemblies for applying heat and pressure to toner particle images on sheet substrates so as to fuse and permanently fix such toner images onto the substrates, each fusing assembly of said plurality of M separate fusing assemblies having at least two different copies per minute fusing speeds, including a minimum speed of N/M copies per minute, thereby allowing for changing fusing speed increasing image quality, and insuring machine reliability and productivity.

2. The electrostatographic reproduction machine of claim 1, wherein said plurality of M fusing assemblies comprises two fusing assemblies.

3. The electrostatographic reproduction machine of claim 1, wherein said at least two different copies per minute fusing speeds of each fusing assembly of said plurality of M fusing assemblies includes a maximum speed of N copies per minute.

4. The electrostatographic reproduction machine of claim 1, wherein said at least two different copies per minute fusing speeds of each fusing assembly are selectable.

5. The electrostatographic reproduction machine of claim 1, wherein said plurality of M fusing assemblies are mounted in parallel and each include means for receiving sheet substrates from said transfer means.

* * * * *